US011747077B2

(12) United States Patent
Park et al.

(10) Patent No.: US 11,747,077 B2
(45) Date of Patent: Sep. 5, 2023

(54) REFRIGERATOR

(71) Applicant: Samsung Electronics Co., Ltd., Suwon-si (KR)

(72) Inventors: Hosang Park, Suwon-si (KR); Sanggyu Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 130 days.

(21) Appl. No.: 17/168,370

(22) Filed: Feb. 5, 2021

(65) Prior Publication Data

US 2021/0247127 A1 Aug. 12, 2021

(30) Foreign Application Priority Data

Feb. 6, 2020 (KR) ..... 10-2020-0014062

(51) Int. Cl.

| | |
|---|---|
| ***F25D 11/00*** | (2006.01) |
| ***F25D 23/00*** | (2006.01) |
| ***F25D 17/06*** | (2006.01) |
| ***F25D 23/06*** | (2006.01) |

(52) U.S. Cl.

CPC ..... *F25D 23/006* (2013.01); *F25D 11/00* (2013.01); *F25D 17/065* (2013.01); *F25D 23/066* (2013.01); *F25D 2201/12* (2013.01); *F25D 2300/00* (2013.01); *F25D 2400/14* (2013.01)

(58) Field of Classification Search

CPC ..... F25D 23/066; F25D 2201/12; F25D 2400/06; F25D 23/00

See application file for complete search history.

(56) References Cited

U.S. PATENT DOCUMENTS

| | | | | |
|---|---|---|---|---|
| 4,618,193 | A | 10/1986 | Cuthbert et al. | |
| 5,921,095 | A | 7/1999 | Lee et al. | |
| 6,036,294 | A * | 3/2000 | Banicevic | F25D 23/069 312/407 |

(Continued)

FOREIGN PATENT DOCUMENTS

| | | | |
|---|---|---|---|
| CN | 110068193 | A | 7/2019 |
| EP | 2 607 824 | A2 | 6/2013 |

(Continued)

OTHER PUBLICATIONS

English Translation of the International Search Report and Written Opinion of the Searching Authority dated May 28, 2021 from International Application No. PCT/KR2021/001309.

(Continued)

*Primary Examiner* — Filip Zec

(74) *Attorney, Agent, or Firm* — STAAS & HALSEY LLP

(57) ABSTRACT

A refrigerator includes an inner case configured to accommodate a refrigerated item therein, an outer case configured to surround the inner case, a heat insulator configured to be at least partially disposed between the inner case and the outer case, and a reinforcing member disposed between the inner case and the outer case to support the outer case and having a fastening part to couple the refrigerator with another refrigerator installed adjacent to the refrigerator by using a connection member, and the fastening part coupled to the connection member to enable alignment between the refrigerator and the another refrigerator.

7 Claims, 15 Drawing Sheets

(56) References Cited

U.S. PATENT DOCUMENTS

| | | | | |
|---|---|---|---|---|
| 7,008,027 | B2 * | 3/2006 | Kelley | A47B 87/008 312/107 |
| 7,478,892 | B2 | 1/2009 | Punzel et al. | |
| 8,579,389 | B1 * | 11/2013 | Kuo | A47B 87/008 312/111 |
| 9,046,298 | B2 | 6/2015 | Laible et al. | |
| 9,743,768 | B2 * | 8/2017 | Hollenbeck | A47B 87/008 |
| 11,248,407 | B2 * | 2/2022 | Azevedo | E05D 7/0423 |
| 11,320,191 | B2 * | 5/2022 | Kang | F25D 17/06 |
| 2006/0125361 | A1 | 6/2006 | Grace et al. | |
| 2006/0255699 | A1 | 11/2006 | Punzel et al. | |
| 2017/0318965 | A1 * | 11/2017 | Hawkins | A47B 96/20 |

FOREIGN PATENT DOCUMENTS

| | | | |
|---|---|---|---|
| JP | 6-159911 | | 6/1994 |
| KR | 20-1984-0007669 | U | 12/1984 |
| KR | 10-0448287 | B1 | 9/2004 |
| KR | 20-2011-0006672 | U | 7/2011 |

OTHER PUBLICATIONS

Office Action dated May 11, 2023 issued in European Application No. EP 21 75 0909.0.

* cited by examiner

REFRIGERATOR

CROSS-REFERENCE TO RELATED APPLICATIONS

This application is based on and claims priority under 35 U. S. C. § 119 to Korean Patent Application No. 10-2020-0014062, filed on Feb. 6, 2020, the disclosure of which is herein incorporated by reference in its entirety.

BACKGROUND

1. Field

The disclosure relates to a refrigerator that cools refrigerated items accommodated in the refrigerator to a preset temperature and maintains the refrigerated items in the cooled state, and more particularly, to a refrigerator to which a structure connecting a plurality of refrigerators is applied when a user wants to install and use the plurality of refrigerators in an installation space.

2. Description of the Related Art

A refrigerator is a household appliance device that includes a storage compartment for accommodating predetermined refrigerated items and a cooling unit that supplies cold air to the storage compartment, and operates to freshly store the refrigerated items accommodated in the storage compartment. The temperature in the storage room is maintained within a preset range required to keep food fresh. The refrigerator includes a housing for forming a storage compartment therein, in which the housing is provided in a dual structure of an outer case and an inner case to maintain the temperature of the storage compartment at an appropriate level, and has a heat insulator foamed between the outer case and the inner case.

A refrigerator is fixed and used in installation spaces such as a kitchen and a living room in home. Although a refrigerator is generally used as a single device, two or more devices may be used together in one installation space due to various factors such as a user's request. For example, in a state in which two refrigerators are adjacent to each other, a front surface of each refrigerator may be disposed to face the same direction. In this state, a structure for physically connecting the two refrigerators may be necessary for an aesthetic point of view, safety in use, and various other reasons.

SUMMARY

According to an embodiment of the disclosure, a refrigerator includes a housing configured to be installed in a predetermined installation space, in which the housing includes an inner case configured to accommodate a refrigerated item therein, an outer case configured to surround the inner case, a heat insulator configured to be at least partially provided between the inner case and the outer case, and a reinforcing member configured to be provided between the inner case and the outer case to support the inner case or the outer case and have a fastening part for connecting between the refrigerator and another refrigerator installed adjacent to the refrigerator by using a connection member in the installation space, and the fastening part is coupled to the connection member to enable alignment between the refrigerator and the another refrigerator.

The outer case may include a fastening part through hole, the reinforcing member may further include a reinforcing member body supporting an inner surface of the outer case, and the fastening part may be provided to be exposed outside the outer case from the reinforcing member body through the fastening part through hole.

In addition, the fastening part may include one or more fastening holes for screwing.

In addition, the fastening portion may extend from the reinforcing member body.

In addition, the fastening part may have a plate surface facing a front of the refrigerator.

In addition, the reinforcing member body may include a first reinforcing part configured to extend along an inner surface of the outer case, and a second reinforcing part configured to be bent and extend from the first reinforcing part at a corner of the housing.

In addition, the reinforcing member may further include a connection member support part protruding from the fastening portion to support the connection member.

In addition, the refrigerator may further include a second reinforcing member configured to be provided at a position different from a position where the reinforcing member is installed in the housing and have a second fastening hole provided so that a second connection member different from the connection member is screwed for connection with the another refrigerator.

In addition, the reinforcing member may be provided below the housing in the installation space, and the second reinforcing member may be provided above the housing.

BRIEF DESCRIPTION OF THE DRAWINGS

The above and other aspects, features, and advantages of certain embodiments of the disclosure will be more apparent from the following description taken in conjunction with the accompanying drawings.

DETAILED DESCRIPTION

Hereinafter, embodiments according to the disclosure will be described in detail with reference to the accompanying drawings. Embodiments described with reference to each drawing are not mutually exclusive configurations unless otherwise specified, and a plurality of embodiments may be selectively combined and implemented in one device. The combination of the plurality of embodiments may be arbitrarily selected and applied by a person skilled in the art of the disclosure in implementing the spirit of the disclosure.

If there are terms including an ordinal number like a first component, a second component, and the like in embodiments, these terms are used to describe various components and discriminate one component from other components, and therefore the meaning of these components are not limited by terms. Terms used in the embodiments are applied to describe the embodiments, and do not limit the spirit of the disclosure.

In addition, in the case where the expression "at least one" of a plurality of components in the present specification appears, the expression refers to not only all of a plurality of components, but each one excluding the rest of the plurality of components or all combinations thereof.

Figure 1:
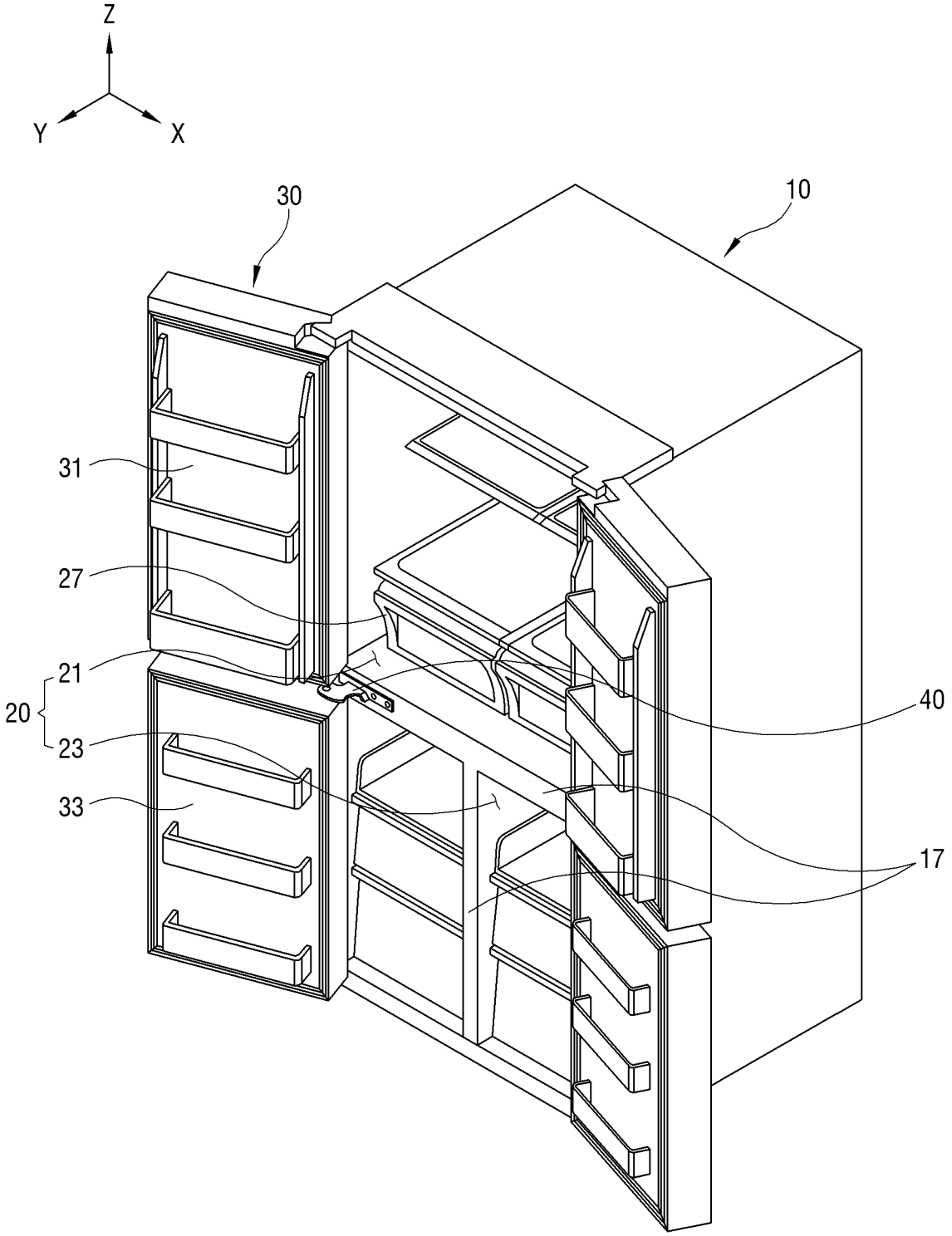
FIG. 1 is a perspective view of a refrigerator.

FIG. 1 is a perspective view of a refrigerator.

Figure 2:
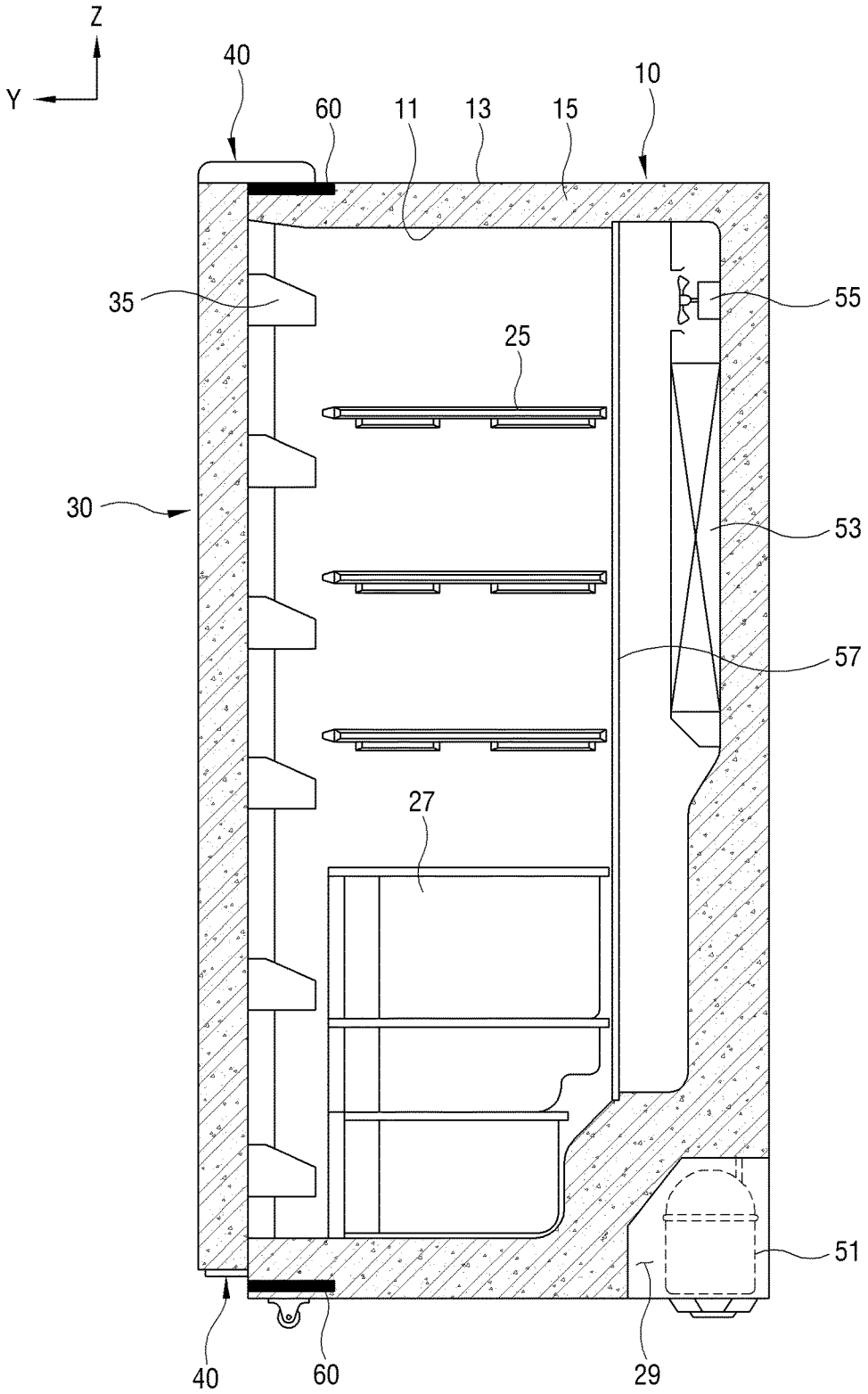
FIG. 2 is a side cross-sectional view of the refrigerator of FIG. 1.

FIG. 2 is a side cross-sectional view of the refrigerator of FIG. 1.

As illustrated in FIGS. 1 and 2, a refrigerator 1 includes a housing 10 forming an appearance. An inside of the housing 10 is provided with a storage compartment 20 that has an open front surface and accommodates predetermined refrigerated items. A door 30 is rotatably coupled to the housing 10 to open and close the open front surface of the storage compartment 20. A hinge part 40 is coupled between the housing 10 and the door 30, thereby enabling the door 30 to rotate with respect to the housing 10.

A direction illustrated in this drawing is defined. An "X" direction is a horizontal direction of the refrigerator 1. A "Y" direction is orthogonal to the X direction, and is a direction toward the front of the refrigerator 1. That is, when the door 30 is opened, the storage compartment 20 is opened toward the Y direction. A "Z" direction is orthogonal to the X and Y directions, and is a vertical direction of the refrigerator 1.

In this embodiment, the refrigerator 1 having a structure in which four doors 30 provided to open and close left and right are provided and the storage compartment 20 is divided into three is illustrated, but the structure of the refrigerator 1 is not limited to the example of this embodiment. For example, only one door 30 may be provided in the refrigerator 1 or two doors 30 may be provided in the refrigerator 1. The storage compartment 20 may not be divided into a plurality or may be divided into two. The hinge part 40 is installed on the left side of the front surface of the housing 10, and thus the door 30 may rotate around a left corner of the front of the housing 10, or conversely, the hinge part 40 is installed on the right side of the front of the housing 10, and thus the door 30 may rotate around a right corner of the front surface of the housing 10.

The housing 10 includes an inner case 11 forming the storage compartment 20, and an outer case 13 accommodating the inner case 11 and forming the appearance. The inner case 11 and the outer case 13 are spaced apart from each other, and a heat insulator 15 for preventing leakage of cold air from the storage compartment 20 is foamed between the inner case 11 and the outer case 13. A material of the heat insulator 15 is not limited, and for example, the heat insulator 15 includes a urethane material.

The housing 10 includes a partition wall 17 that partitions the storage compartment 20 left and right or up and down. The storage compartment 20 may be divided into a refrigerating compartment 21 and a freezing compartment 23 by the partition wall 17. The refrigerating compartment 21 and the freezing compartment 23 are only names according to their function, and each storage area of the storage compartment 20 partitioned by the partition wall 17 may switch the refrigerating compartment 21 and the freezing compartment 23 according to the temperature setting. A plurality of shelves 25 and storage containers 27 are provided inside the storage compartment 20 to place refrigerated items.

When the storage compartment 20 is divided into the refrigerating compartment 21 and the freezing compartment 23 by the partition wall 17, the door 30 includes a refrigerating compartment door 31 provided to open and close the refrigerating compartment 21 and a freezing compartment door 33 provided to open and close the freezing compartment 23. A plurality of door guards 35 for accommodating refrigerated items are provided on a rear surface of the refrigerating compartment door 31 or the freezing compartment door 33.

The refrigerator 1 has a cooling unit that supplies cold air to the storage compartment 20 based on a heat exchange principle of the refrigerant. The cooling unit includes a compressor 51 that compresses a refrigerant, a condenser that condenses the refrigerant to cause an exothermic reaction, an evaporator 53 that evaporates the refrigerant to causes an endothermic reaction, a blowing fan 55 that blows air, a cold air duct 57 that guides the movement of air cooled by an evaporator 53, and the like. The compressor 51 and the condenser are disposed in a machine room 29 located below a rear of the housing 10. The evaporator 53, the blowing fan 55, and the cold air duct 57 are disposed at the rear of the storage compartment 20. However, the disposition position of each component of the cooling unit is not limited by this embodiment.

Meanwhile, the refrigerator 1 includes a reinforcing member 60 that is installed between the inner case 11 and the outer case 13 and is provided to support the inner case 11 or the outer case 13. One or more reinforcing members 60 may be installed as needed. For example, in this drawing, the reinforcing member 60 may be provided at a lower corner of the housing 10 and an upper corner of the housing 10, respectively. For example, the reinforcing member 60 may be embedded between the outer case 13 and the inner case 11 in which the heat insulator 15 is foamed to support the inner surface of the outer case 13, thereby reinforcing the rigidity of the outer case 13.

The refrigerator 1 may be installed in a predetermined installation space and used alone, or may be used in a state in which two or more refrigerators 1 are disposed side by side depending on the purpose. Hereinafter, the case where a plurality of refrigerators 1 are disposed side by side and used will be described.

Figure 3:
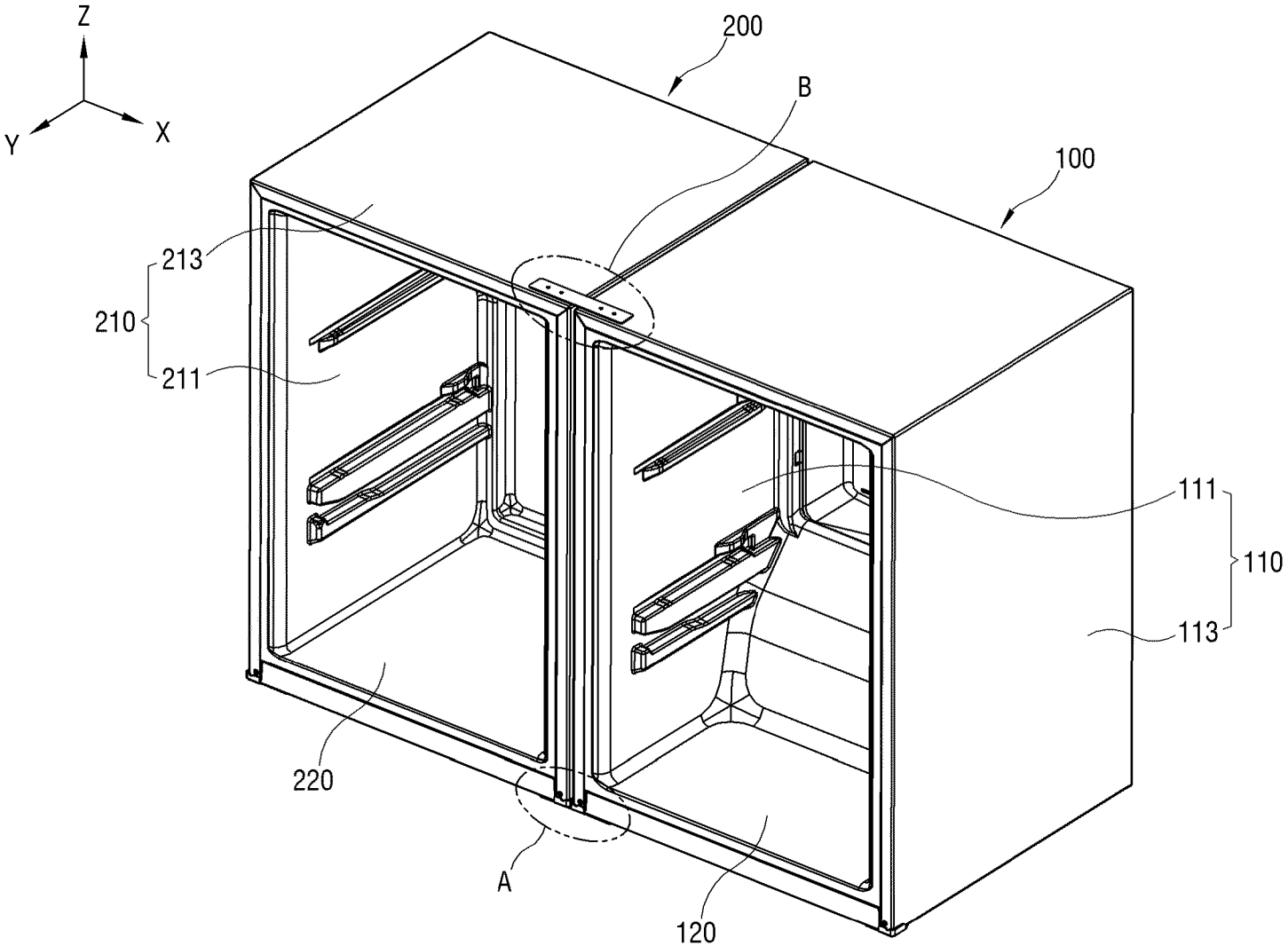
FIG. 3 is a perspective view illustrating a state in which two refrigerators are installed side by side.

FIG. 3 is a perspective view illustrating a state in which two refrigerators are installed side by side.

As illustrated in FIG. 3, a plurality of refrigerators 100 and 200, for example, two refrigerators 100 and 200 may be installed side by side in a predetermined installation space. In order to briefly and clearly describe the embodiment, this drawing reveals that only some components related to this embodiment are illustrated in the first refrigerator 100 and the second refrigerator 200. The first refrigerator 100 and the second refrigerator 200 may have substantially the same or similar models and standards, but are different models depending on the design method and are prepared to have a common standard for the connection structure to be described later. In addition, as in this embodiment, not only two refrigerators 100 and 200 but also three or more refrigerators may be installed side by side. In this case, this embodiment can be applied, and therefore a detailed description thereof will be omitted.

The first refrigerator 100 includes a first housing 110. The first housing 110 includes a first inner case 111 forming a first storage compartment 120 and a first outer case 113 forming an appearance. The second refrigerator 200 also includes a second housing 210 similar to the structure of the first refrigerator 100. The second housing 210 includes a second inner case 211 forming a second storage compartment 220 and a second outer case 213 forming an appearance.

The first refrigerator 100 and the second refrigerator 200 are disposed side by side adjacent to each other. That is, a right wall (that is, side wall in the X direction) of the first housing 110 and a left wall (that is, side wall in a −X direction) of the second housing 210 are disposed to be in contact with each other, or to face each other at least in a state adjacent to each other. The first storage compartment 120 and the second storage compartment 220 open in the same direction, for example in the Y direction.

The first refrigerator 100 and the second refrigerator 200 may be disposed at a position where the first refrigerator 100 and the second refrigerator 200 are aligned with each other according to various purposes (for example, aesthetic purpose, use convenience, or functional purpose such as connection of refrigerant flow, and the like). In particular, examples of functional purposes among various purposes will be described later. Here, the alignment between the position of the first refrigerator 100 and the position of the second refrigerator 200 includes alignment according to a height (that is, Z direction) and alignment according to a front-rear direction (that is, Y direction).

In this embodiment, in order to maintain the mutually aligned positions of the first refrigerator 100 and the second refrigerator 200, at least one of connection structures A and B that physically connects the first refrigerator 100 and the second refrigerator 200 is applied. This embodiment describes an example in which the two places of the connection structure A provided on a lower front of the first housing 110 and the second housing 210 and the connection structure B provided on upper plate surfaces of the first housing 110 and the second housing 210 physically connect the first refrigerator 100 and the second refrigerator 200. However, the structure, number, installation positions, and the like of connection structures A and B connecting the first refrigerator 100 and the second refrigerator 200 are not limited by this embodiment, and this embodiment is only illustrative.

In addition, the two connection structures A and B to be described below are not necessarily provided only at positions specified in the embodiment in the first refrigerator 100 and the second refrigerator 200. For example, the connection structure A and B may be applied only to any one of the lower fronts of the first housing 110 and the second housing 210 and the upper plate surfaces of the first housing 110 and the second housing 210. Alternatively, the first connection structure A may be applied both to the lower fronts of the first housing 110 and the second housing 210 and the upper plate surfaces of the first housing 110 and the second housing 210. Alternatively, the second connection structure B may be applied both to the lower fronts of the first housing 110 and the second housing 210 and the upper plate surfaces of the first housing 110 and the second housing 210. Alternatively, the second connection structure B may be applied to the lower fronts of the first housing 110 and the second housing 210, and the first connection structure A may be applied to the upper plate surfaces of the first housing 110 and the second housing 210. As described above, the connection structures A and B described below may be applied to connect the first refrigerator 100 and the second refrigerator 200, including cases not described in the embodiment.

Hereinafter, the embodiment of the first connection structure will be described.

Figure 4:
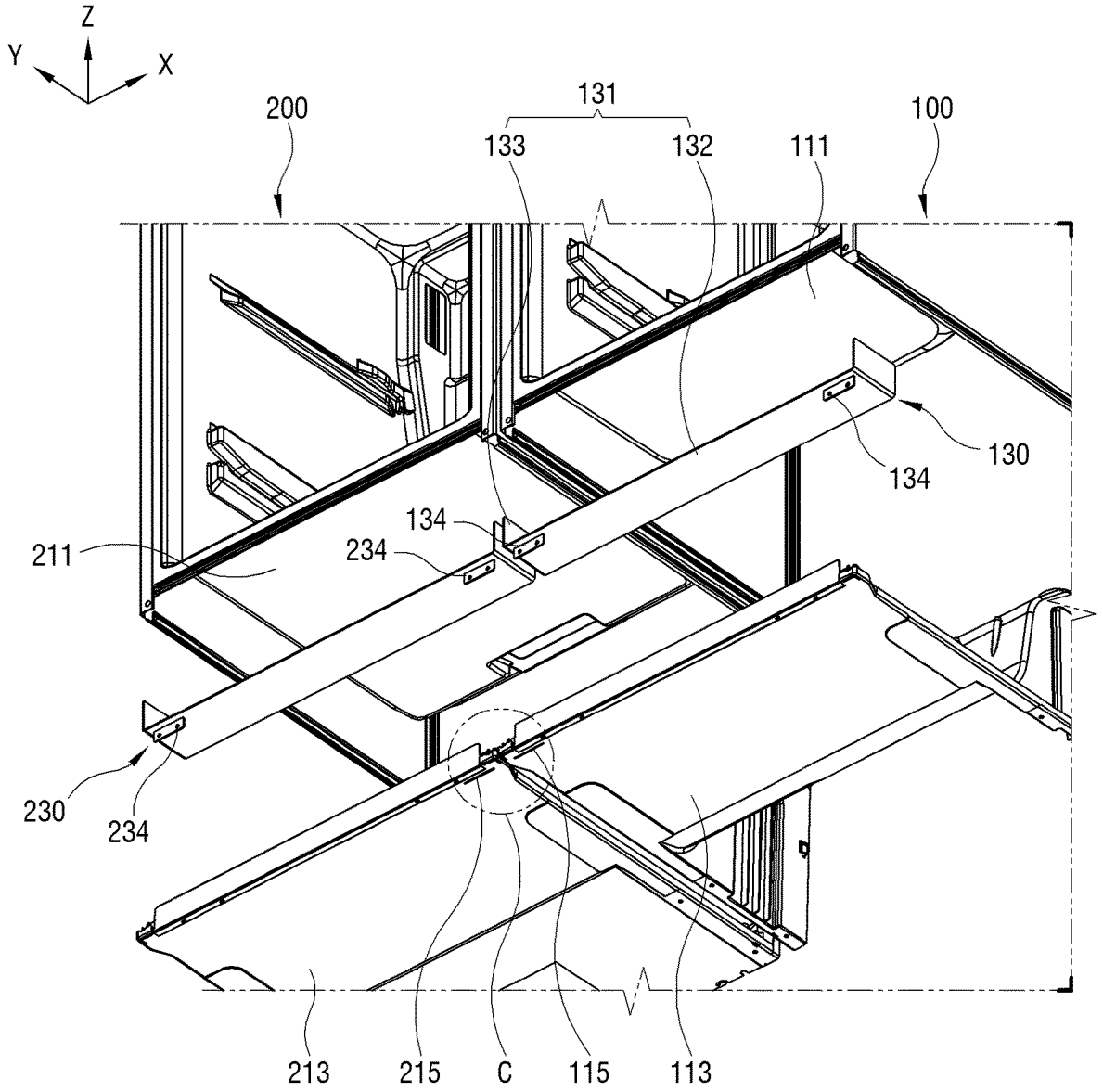
FIG. 4 is an exploded perspective view of a first connection structure in FIG. 3.

FIG. 4 is an exploded perspective view of the first connection structure in FIG. 3.

Figure 5:
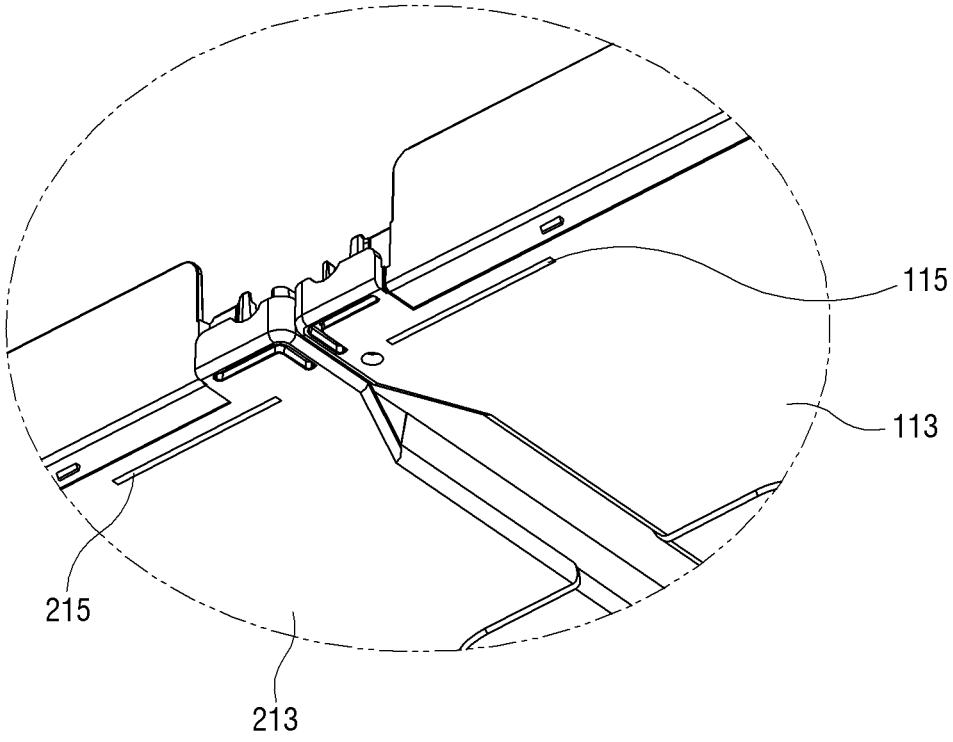
FIG. 5 is a perspective view of a main part illustrating an enlarged state of area C of FIG. 4.

FIG. 5 is a perspective view of a main part illustrating an enlarged state of area C of FIG. 4.

As illustrated in FIGS. 4 and 5, the connection structure connecting the first refrigerator 100 and the second refrigerator 200 may be installed, for example, at the lower front of the first refrigerator 100 and the second refrigerator 200. The connection structure provided in the first refrigerator 100 is symmetrically provided with the corresponding connection structure provided in the second refrigerator 200, and these connection structures are disposed adjacent to each other when the first refrigerator 100 and the second refrigerator 200 are arranged side by side. That is, when the first refrigerator 100 is disposed on the right side of the second refrigerator 200, the connection structure provided in the first refrigerator 100 is arranged close to the left corner of the first refrigerator 100, and the corresponding connection structure provided in the second refrigerator 200 is arranged close to the right corner of the second refrigerator 200.

Hereinafter, the connection structures provided to correspond to each other in the first refrigerator 100 and the second refrigerator 200 will be described. In the case of the first refrigerator 100, a first reinforcing member 130 is interposed between the first inner case 111 and the first outer case 113 of the first housing (see 110 in FIG. 3) (specifically, between a plate forming a bottom surface of the first inner case 111 and a plate forming a bottom surface of the first outer case 113).

The first reinforcing member 130 includes a reinforcing member body 131 that supports the first outer case 113 on a rear surface (that is, inner surface) of the first outer case 113. When manufacturing the first housing (see 110 in FIG. 3), a heat insulator is foamed between the first inner case 111 and the first outer case 113 while the reinforcing member body 131 is disposed on the rear surface of the first outer case 113. For this reason, when the first inner case 111 and the first outer case 113 are combined (see FIG. 5), the reinforcing member body 131 is substantially hidden by the first outer case 113 and becomes invisible. The reinforcing member body 131 includes a first reinforcing part 132 that extends along the inner surface of the first outer case 113 and a second reinforcing part 133 that is bent and extends from the first reinforcing part 132 at a corner (that is, an area where the first outer case 113 is bent) of the first outer case 113. That is, the first reinforcing part 132 supports a lower portion of the first outer case 113, and the second reinforcing part 133 supports a side portion of the first outer case 113, respectively. With this structure, the reinforcing member body 131 may be reinforced so that the first outer case 113 is not bent by force applied in various directions.

In this embodiment, the first reinforcing member 130 includes a first fastening part 134 supported by the reinforcing member body 131 and exposed outside the first outer case 113. Before the heat insulator is foamed between the first inner case 111 and the first outer case 113, the first reinforcing member 130 is adhered to the rear surface of the first outer case 113 using a predetermined adhesive means. As described above, the heat insulator is foamed while the first reinforcing member 130 is adhered to the rear surface of the first outer case 113, so the first reinforcing member 130 is supported at its position. Here, the adhesive means may include an adhesive including various types of resins such as polyester, polyurethane, polyacrylic, epoxy, and silicone.

The first fastening part 134 is exposed outside the first outer case 113 through a first fastening part through hole 115 formed in the first outer case 113. The first fastening part 134 may be provided to be coupled to the reinforcing member body 131 or may extend from the reinforcing member body 131. An extending direction of the first fastening part 134 is not limited, but may be designed according to extending directions of the first reinforcing part 132 and the second reinforcing part 133, respectively, as an example. For example, the first fastening part 134 has a shape protruding from the first reinforcing part 132, and therefore may be orthogonal to the extending direction of the first reinforcing part 132. In addition, the first fastening part 134 is exposed to the outside of the bottom surface of the first outer case 113, and may extend in a direction opposite to the extending direction of the second reinforcing part 133 extending along a side wall of the first outer case 113.

In this embodiment, the first fastening part 134 is disposed so that its plate surface faces the front side (that is, Y direction) of the first refrigerator 100. A plurality of first fastening holes 135 are formed to penetrate through the plate surface of the first fastening part 134 to be spaced apart from each other. A more specific structure of the first fastening part 134 and the first fastening hole 135 will be described later.

In the case of the second refrigerator 200, a second reinforcing member 230 is interposed between the second inner case 211 and the second outer case 213 of the second housing (specifically, between a plate forming a bottom surface of the second inner case 211 and a plate forming a bottom surface of the second outer case 213). The second fastening part 234 is exposed outside the second outer case 213 through a second fastening part through hole 215 formed in the second outer case 213. The second reinforcing member 230 basically has a structure similar to the first reinforcing member 130. However, the position of the second fastening part 234 in the second reinforcing member 230 is symmetrically provided with the position of the first fastening part 134 in the first reinforcing member 130. For example, when viewed the first refrigerator 100 and the second refrigerator 200 from the front, the first fastening part 134 is disposed to be biased to the left of the first reinforcing member 130 and the second fastening part 234 is disposed to be biased to the right of the second reinforcing member 230. The first fastening part 134 and the second fastening part 234 are disposed adjacent to each other, and thus the connection member 300 (see FIG. 6) to be described later is provided to connect between the first fastening part 134 and the second fastening part 234.

This embodiment illustrates the case where the two first fastening parts 134 are arranged symmetrically so that both ends of the reinforcing member body 131 are close to each other. In the case of such a structure, this embodiment may be applied to the case where the first refrigerator 100 is disposed not only on the right side but also on the left side of the second refrigerator 200. However, such a structure is not necessarily required, and it is possible that only one of the first fastening parts 134 is disposed so as to be close to any one of both ends of the reinforcing member body 131. A similar structure may be applied to the second fastening part 234 of the second refrigerator 200.

However, if the first fastening part 134 is disposed only on the left side of the first reinforcing member 130 and the second fastening part 234 is disposed only on the right side of the second reinforcing member 230, the first refrigerator 100 is disposed on the right side of the second refrigerator 200, and therefore the relative position of the first refrigerator 100 and the second refrigerator 200 is fixed. Therefore, it is preferable the first fastening part 134 is symmetrically disposed to the right side as well as the left side of the first reinforcing member 130. For the same reason, the second fastening part 234 may be symmetrically disposed not only on the right side but also on the left side of the second reinforcing member 230. With this structure, the embodiment of the disclosure may be applied even when the first refrigerator 100 is disposed on the left side of the second refrigerator 200.

Figure 6:
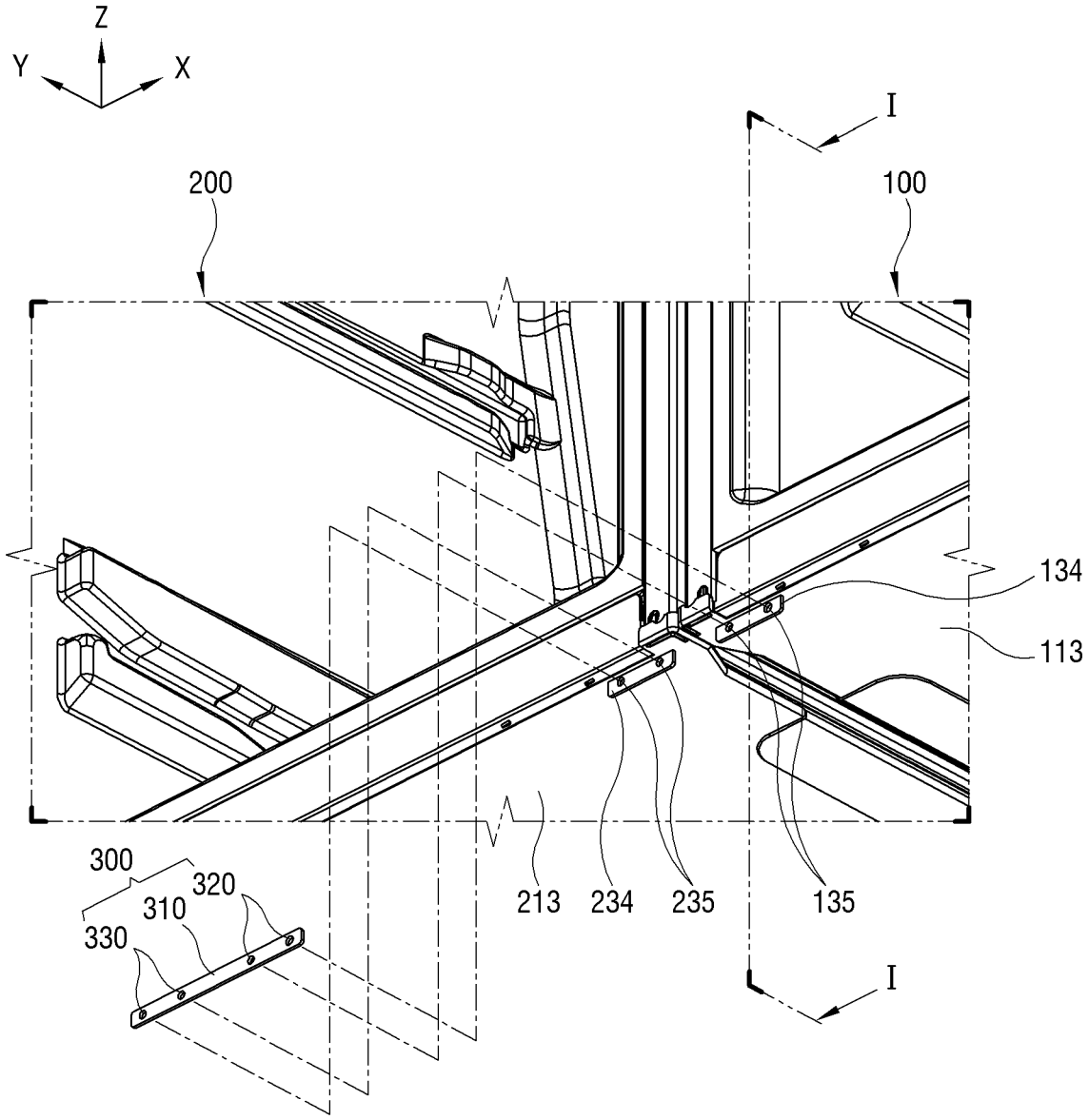
FIG. 6 is a perspective view illustrating a state in which a connection member is not coupled to a first connection structure.

FIG. 6 is a perspective view illustrating a state in which the connection member is not coupled to the first connection structure.

Figure 7:
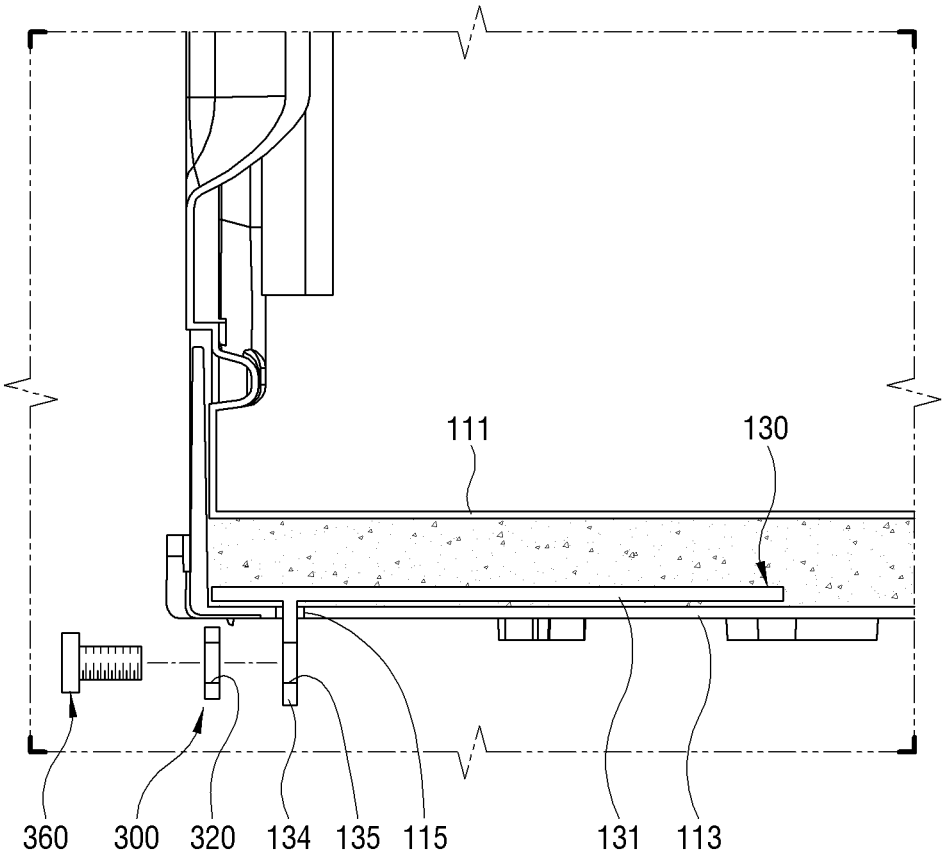
FIG. 7 is a cross-sectional view taken along line I-I of FIG. 6.

FIG. 7 is a cross-sectional view taken along line I-I of FIG. 6.

Figure 8:
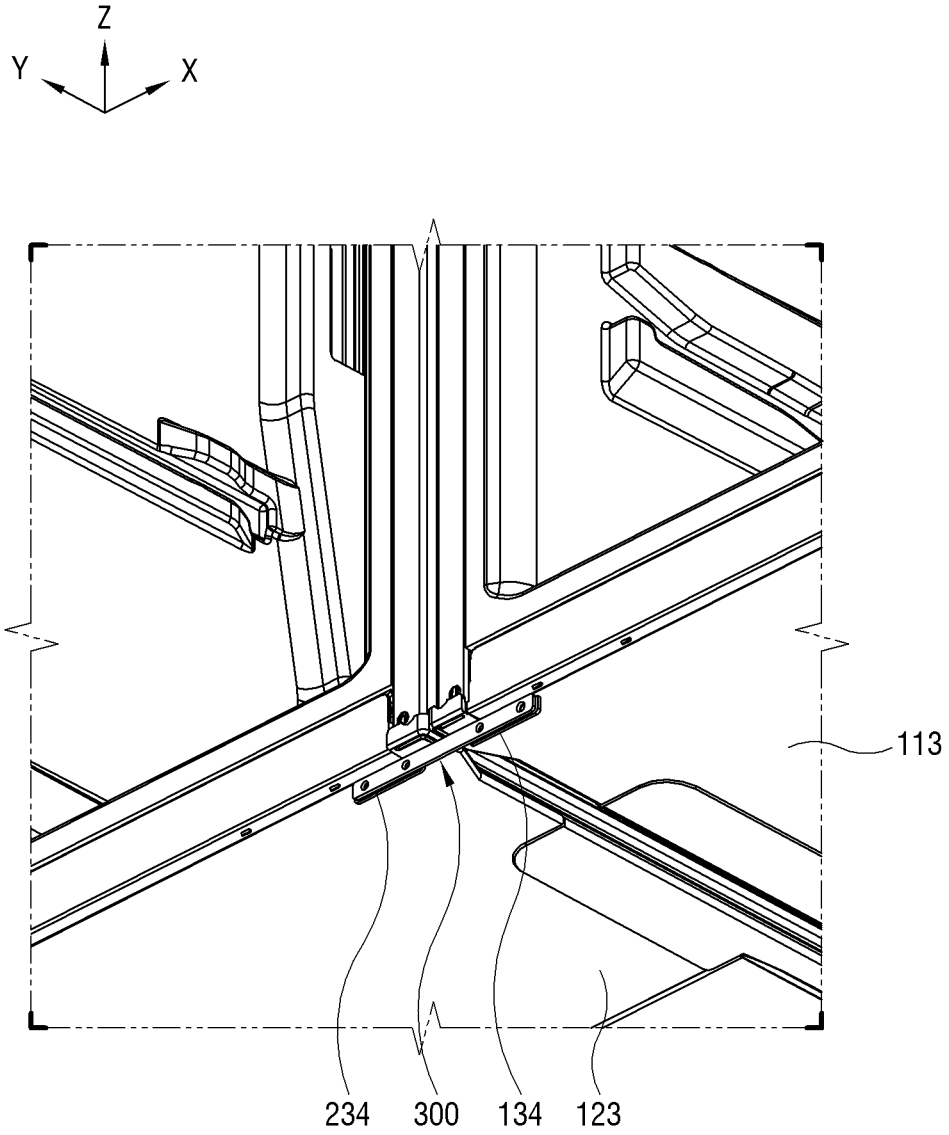
FIG. 8 is a perspective view illustrating a state in which a connection member is not coupled to a first connection structure in FIG. 6.

FIG. 8 is a perspective view illustrating a state in which the connection member is not coupled to the first connection structure in FIG. 6.

As illustrated FIGS. 6, 7, and 8, in the first refrigerator 100, the first fastening part 134 is exposed outside from the reinforcing member body 131 of the first reinforcing member 130 through the first fastening part through hole 115 of the first outer case 113. The second reinforcing member 230 of the second refrigerator 200 also has a similar structure thereto.

The connection member 300 is coupled to the first fastening part 134 and the second fastening part 234 together in the state in which the first refrigerator 100 and the second refrigerator 200 are disposed adjacent to each other. The connection member 300 includes a connection member body 310 including a plate extending to a predetermined length, and a plurality of first connection member fastening holes 320 and a plurality of second connection member fastening holes 330 that are formed to penetrate through the connection member body 310. The plurality of first connection member fastening holes 320 are each screwed to the plurality of first fastening holes 135 by a screw 360 to couple the connection member 300 to the first fastening part 134. In addition, the plurality of second connection member fastening holes 330 are respectively screwed to the plurality of second fastening holes 235 by a screw 360 to couple the connection member 300 to the second fastening part 234. That is, the first connection member fastening hole 320 and the second connection member fastening hole 330 are disposed at positions corresponding to the first fastening hole 135 and the second fastening hole 235, respectively. Since the first fastening part 134 and the second fastening part 234 face the front of the first refrigerator 100 and the second refrigerator 200, respectively, the user may easily couple the connection member 300 by the screw 360.

This embodiment has described that the first fastening part 134 and the second fastening part 234 are provided with the first fastening hole 135 and the second fastening hole 235 having a thread by the screw 360. However, depending on the design method, a fastening structure such as a bolt other than the fastening holes 135 and 235 from the first fastening part 134 or the second fastening part 234 may be provided. For example, the bolt may extend from the first fastening part 134, and the bolt penetrating through a hole formed in the connection member 300 may be provided to be fastened by a nut.

In this way, the connection member 300 is coupled to the first fastening part 134 and the second fastening part 234 together, thereby physically connecting the first refrigerator 100 and the second refrigerator 200, and maintaining the position alignment of the first refrigerator 100 and the second refrigerator 200.

Hereinafter, the relative positions of the first fastening hole 135, the second fastening hole 235, the first connection member fastening hole 320, and the second connection member fastening hole 330 will be described.

Figure 9:
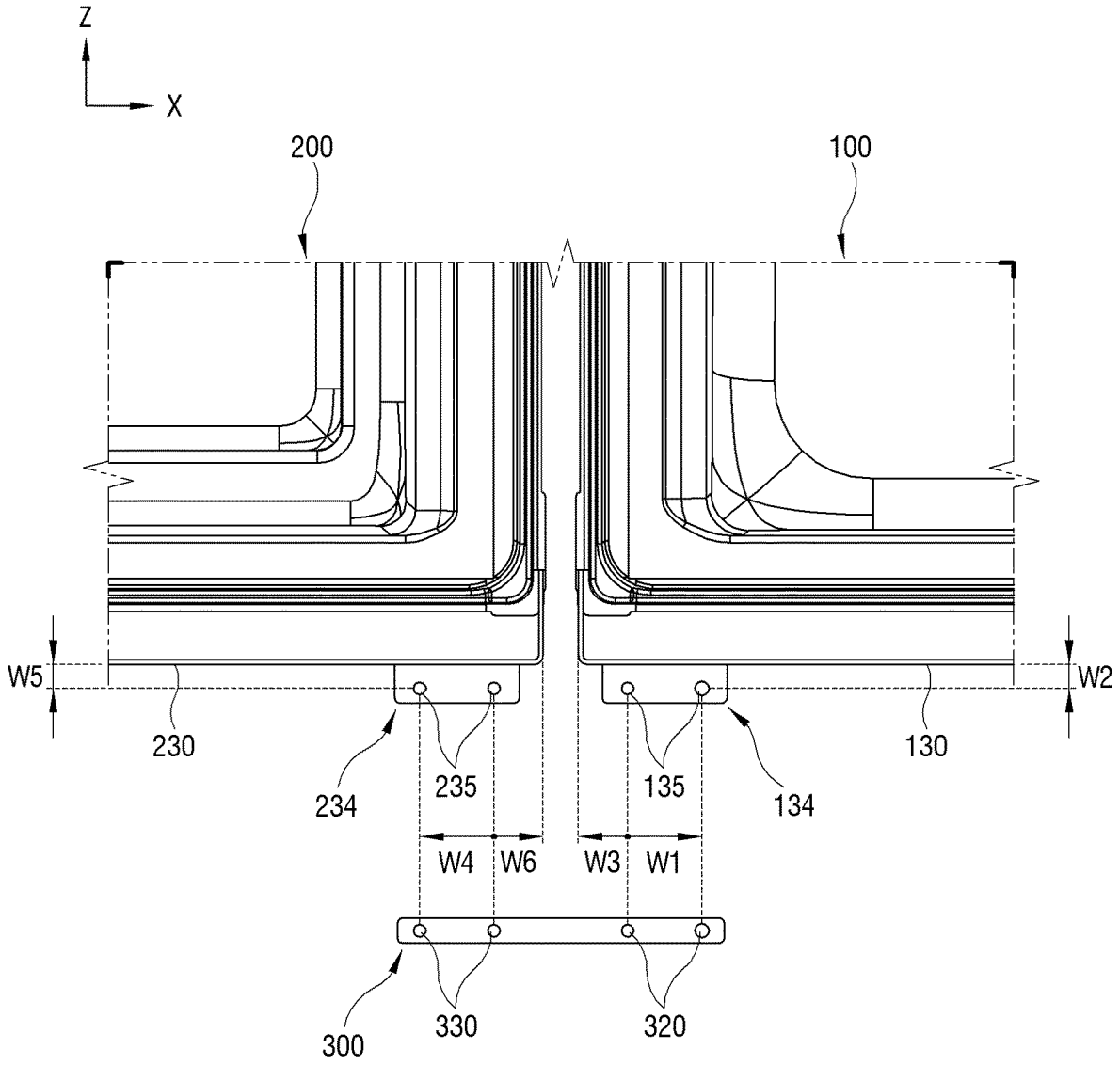
FIG. 9 is an exemplary view illustrating a state of a first fastening part and a second fastening part viewed from the front.

FIG. 9 is an exemplary view illustrating a state of the first fastening part and the second fastening part viewed from the front.

As illustrated in FIG. 9, when the first refrigerator 100 and the second refrigerator 200 are at the aligned position to each other, the first fastening part 134 of the first reinforcing member 130 and the second fastening part 234 of the second reinforcing member 230 are disposed adjacent to each other in the same direction. In this state, the connection member 300 is coupled to the first fastening part 134 and the second fastening part 234 together, thereby physically connecting the first refrigerator 100 and the second refrigerator 200. Specifically, the plurality of first connection member fastening holes 320 are each screwed to the plurality of first fastening holes 135 by the screw, and the plurality of second fastening holes 235 are respectively screwed to the plurality of second connection member fastening holes 330 by the screw. Inner circumferential surfaces of the first fastening hole 135, the second fastening hole 235, the first connection member fastening hole 320, and the second connection member fastening hole 330, respectively, have a thread formed for screwing with a screw. Alternatively, the coupling using the bolt and the nut is also possible.

In this embodiment, two first fastening holes 135 are provided, and two second fastening holes 235 are provided. In response to this, two first connection member fastening holes 320 are provided, and two second connection member fastening holes 330 are provided. The number of first connection member fastening holes 320 corresponds to the number of first fastening holes 135, and the number of second connection member fastening holes 330 corresponds to the number of second fastening holes 235.

The number of first fastening holes 135 and second fastening holes 235, respectively, is not limited. For example, only one first fastening hole 135 and one second fastening hole 235 may be provided. In this case, the first refrigerator 100 and the second refrigerator 200 may be aligned in the front-rear direction. However, in order to align the first refrigerator 100 and the second refrigerator 200 in the front-rear direction and the up-down direction, the number of first fastening holes 135 and second fastening holes 235, respectively, is at least two as in this embodiment.

The plurality of first fastening holes 135 and the plurality of second fastening holes 235 are disposed on a straight line along the X direction, for example. If a distance between the two adjacent first fastening holes 135 is W1 and a distance between the two adjacent second fastening holes 235 is W4, W1=W4 is satisfied. If a shortest distance from the reinforcing member body of the first reinforcing member 130 to each first fastening hole 135 is W2 and a shortest distance from the reinforcing member body of the second reinforcing member 230 to each second fastening hole 235 is W5, W2=W5 is satisfied. If a distance from the left corner of the first refrigerator 100 to the first fastening hole 135 closest to the corresponding corner is W3 and a distance from the right corner of the second refrigerator 200 to the second fastening hole 235 closest to the corresponding corner is W6, W3=W6 is satisfied. With this structure, a standardized connection structure may be commonly applied to the refrigerators 100 and 200.

This embodiment has described the case where the plurality of first fastening holes 135 and the plurality of second fastening holes 235 are provided on a straight line. However, this is only an example in which the plurality of first fastening holes 135 and the plurality of second fastening holes 235 are provided symmetrically, and the disposition structure of the plurality of first fastening holes 135 and the plurality of second fastening holes 235 is not limited. Hereinafter, an example of other disposition structures of the plurality of first fastening holes 135 and the plurality of second fastening holes 235 will be described.

Figure 10:
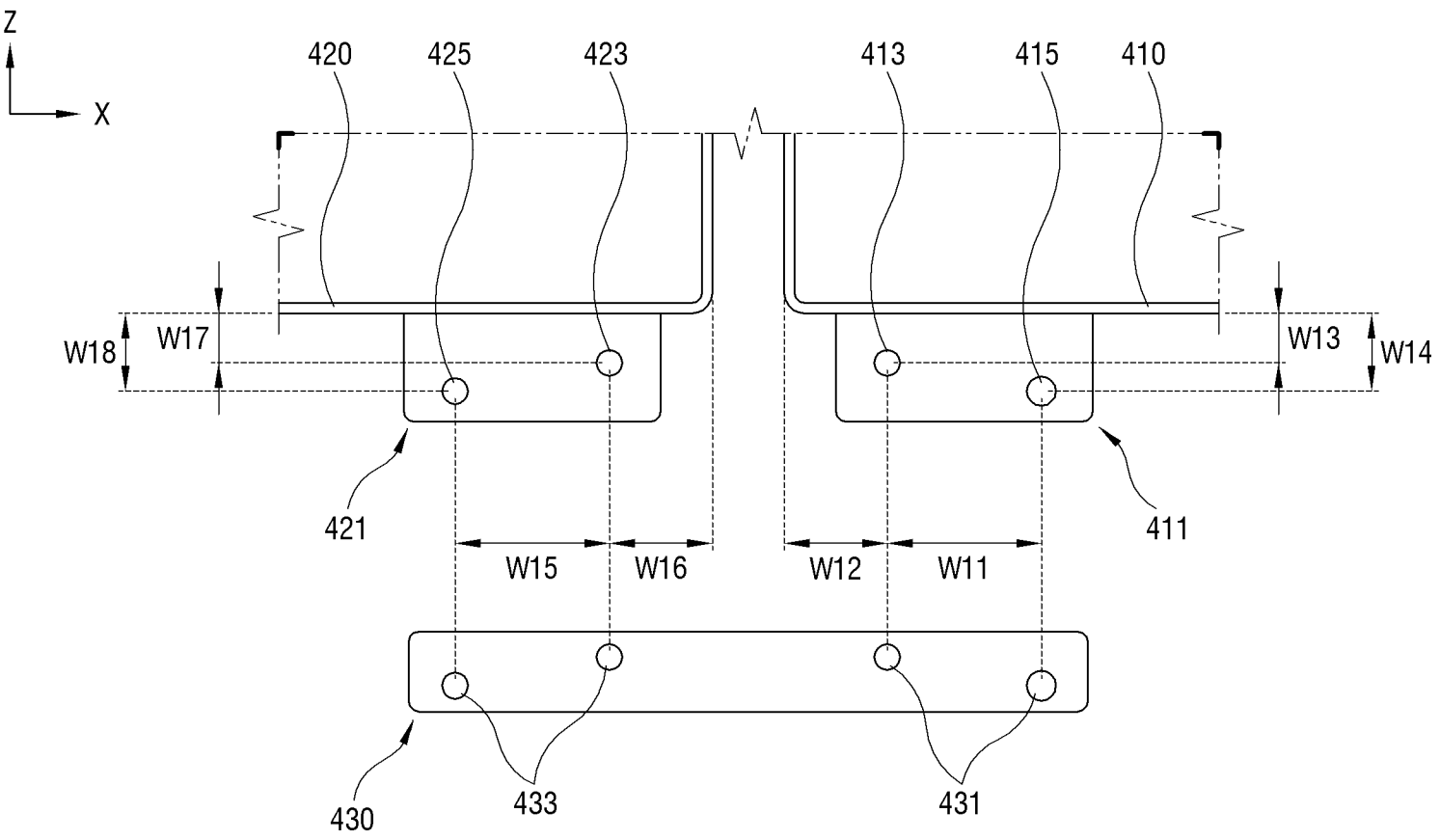
FIG. 10 is an exemplary view illustrating the state of the first fastening part and the second fastening part having a structure different from that of FIG. 9 viewed from the front.

FIG. 10 is an exemplary view illustrating the state of the first fastening part and the second fastening part having a structure different from that of FIG. 9 viewed from the front.

As illustrated in FIG. 10, when the first refrigerator and the second refrigerator are at the aligned position to each other, a first fastening part 411 of a first reinforcing member 410 and a second fastening part 421 of a second reinforcing member 420 are disposed adjacent to each other in the same direction.

In this embodiment, two first fastening holes 413 and 415 and two second fastening holes 423 and 425 are provided, respectively, and a first connection member fastening hole 431 and a second connection member fastening hole 433 are provided in the connection member 430 corresponding thereto. In this embodiment, the plurality of first fastening holes 413 and 415 are not disposed on the same straight line, and the plurality of first fastening holes 413 and 415 are not disposed on the same straight line.

If a distance between the two adjacent first fastening holes 413 and 415 is W11 and a distance between the two adjacent second fastening holes 423 and 425 is W15, W11=W15 is satisfied. If a distance from the left corner of the first refrigerator to the first fastening holes 413 and 415 closest to the corresponding corner is W12 and a distance from the right corner of the second refrigerator to the second fastening holes 423 and 425 closest to the corresponding corner is W16, W12=W16 is satisfied. If a shortest distance from the bottom surface of the reinforcing member body of the first reinforcing member 410 to the first fastening hole 413 disposed closest thereto is W13 and a shortest distance from the bottom surface of the reinforcing member body of the second reinforcing member 420 to the second fastening hole 423 disposed closest thereto is W17, W13=W17 is satisfied. If a shortest distance to the first fastening hole 415 disposed farthest from the bottom surface of the reinforcing member body of the first reinforcing member 410 is W13, and a shortest distance to the second fastening hole 425 disposed farthest from the bottom surface of the reinforcing member body of the second reinforcing member 420 is W17, W13=W17 is satisfied.

The first connection member fastening hole 431 and the second connection member fastening hole 433 are formed to penetrate through the connection member 430 so as to correspond to the positions of the first fastening holes 413 and 415 and the second fastening holes 423 and 425.

Hereinafter, an embodiment of the second connection structure B (see FIG. 3) illustrated in FIG. 3 will be described.

Figure 11:
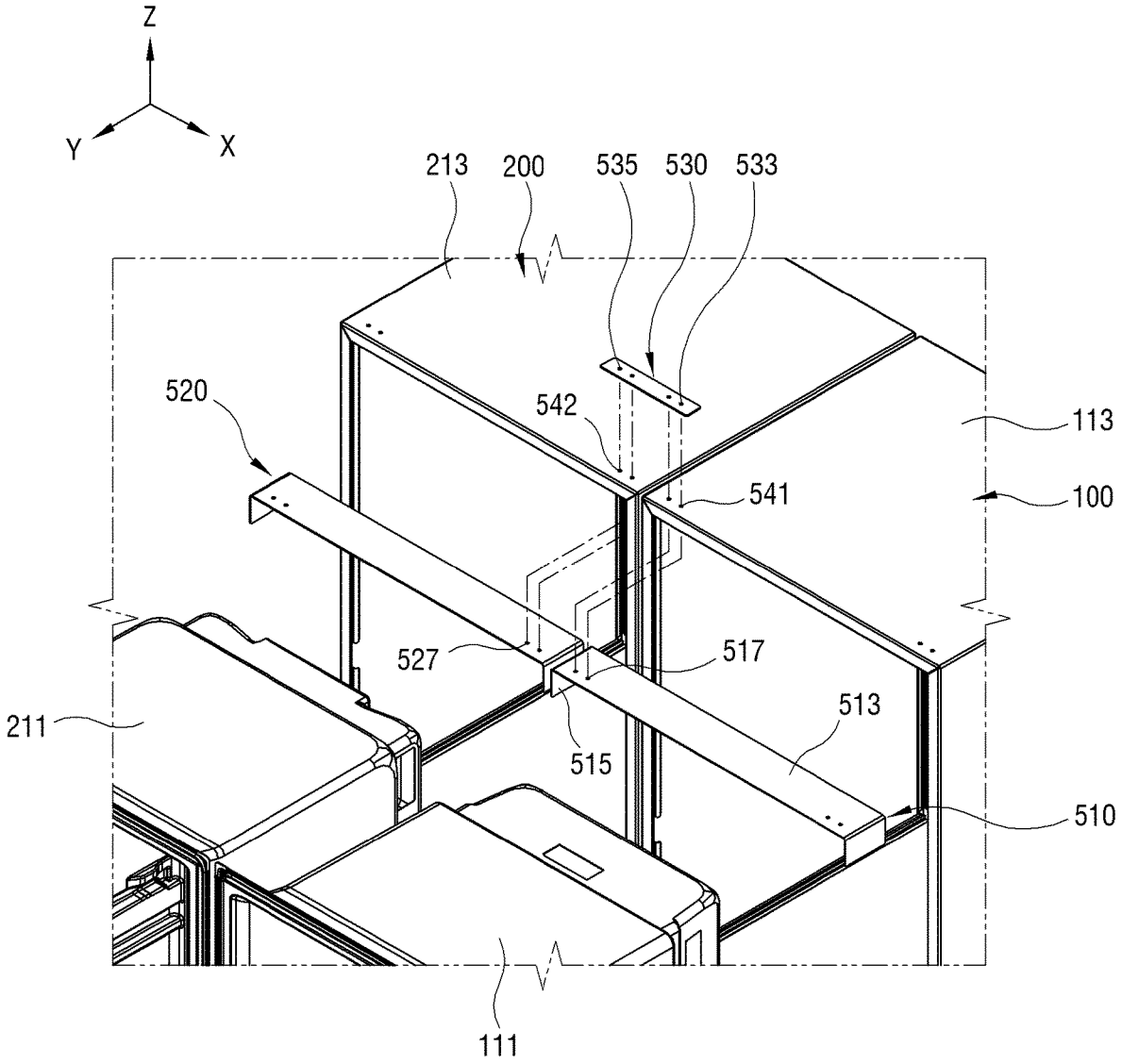
FIG. 11 is an exploded perspective view of a second connection structure in FIG. 3.

FIG. 11 is an exploded perspective view of the second connection structure in FIG. 3.

Figure 12:
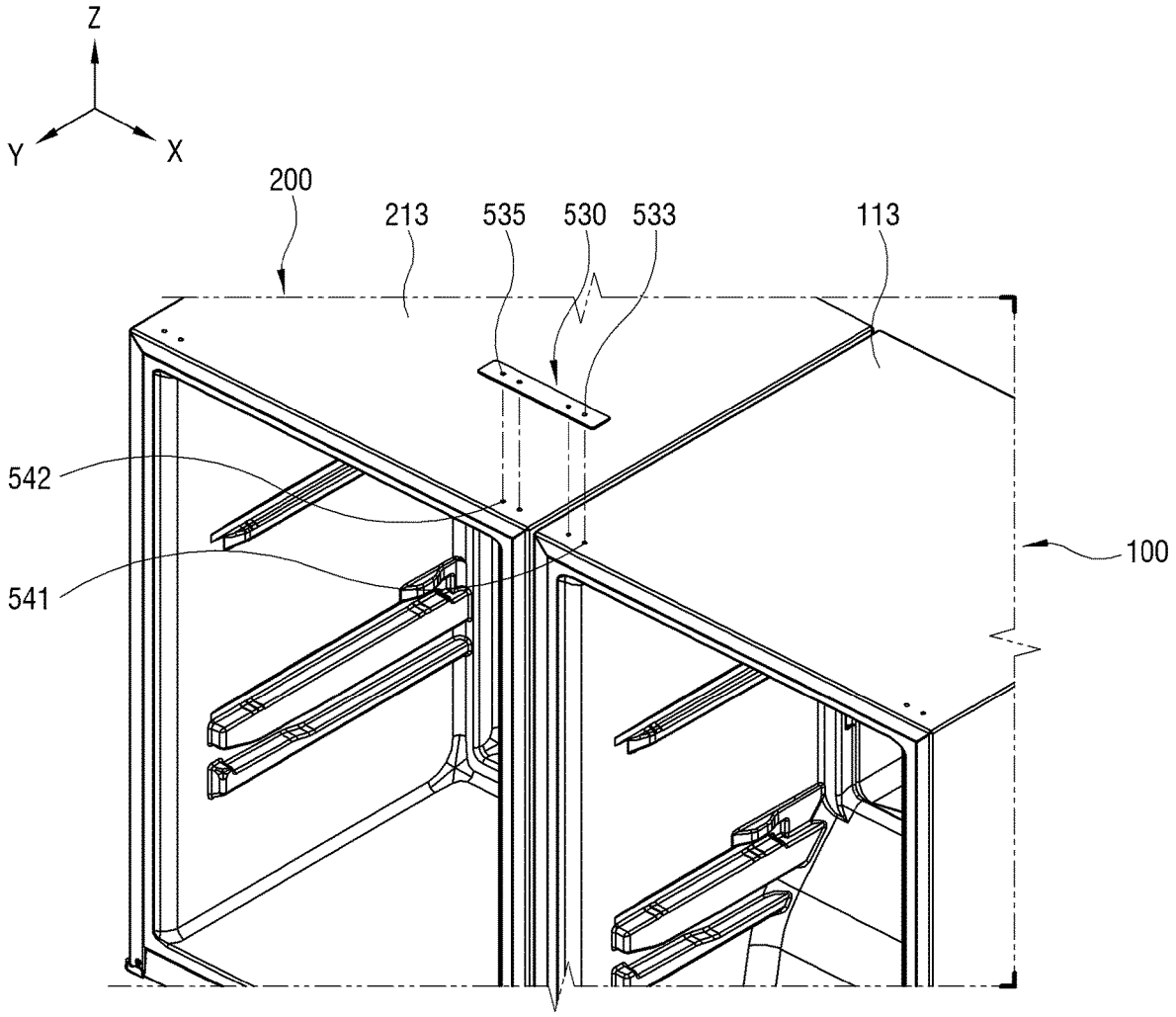
FIG. 12 is a perspective view illustrating a state in which the connection member is not coupled to the second connection structure.

FIG. 12 is a perspective view illustrating a state in which the connection member is not coupled to the second connection structure.

As illustrated in FIGS. 11 and 12, the first refrigerator 100 and the second refrigerator 200 are disposed side by side adjacent to each other in the Y direction. A first reinforcing member 510 is interposed between the upper surface of the first inner case 111 and the upper surface of the first outer case 113 of the first refrigerator 100. The first reinforcing member 510 is provided on the upper side of the first refrigerator 100 to reinforce the rigidity of the upper surface of the first outer case 113. Similarly, a second reinforcing member 520 is interposed between the upper surface of the second inner case 211 and the upper surface of the second outer case 213 of the second refrigerator 200. The first reinforcing member 510 is adhered to the inner surface of the first outer case 113 by an adhesive means such as an adhesive, and in this state, the heat insulator is foamed between the first inner case 111 and the first outer case 113, and thus the first reinforcing member 510 is supported inside the first outer case 113.

The first reinforcing member 510 includes a first reinforcing part 513 extending along the upper surface of the first outer case 113 and a second reinforcing part 515 that is bent from an end portion of the first reinforcing part 513 so as to extend along the side surface of the first outer case 113. A plurality of first fastening holes 517 are formed on an area (that is, an area adjacent to the side corner of the first refrigerator 100) adjacent to the second reinforcing part 515 to penetrate through the first reinforcing part 513. The second reinforcing member 520 also has a structure similar to that of the first reinforcing member 510, and a plurality of second fastening holes 527 are formed to penetrate through an area adjacent to the side corner of the second refrigerator 200.

This embodiment may be applied even when the plurality of first fastening holes 517 are provided only at one end portion of the first reinforcing part 513. However, in this case, the first refrigerator 100 needs to be disposed on the left side of the second refrigerator 200 due to the position of the first fastening hole 517. In order to avoid this situation, the plurality of first fastening holes 517 are symmetrically provided at both ends of the first reinforcing part 513. The same goes for the plurality of second fastening holes 527.

Since the connection structure of this embodiment is provided on the upper plate surfaces of the first refrigerator 100 and the second refrigerator 200, the user may relatively easily perform screwing by the screw. Accordingly, in this embodiment, the plurality of first fastening holes 517 are not provided in an area (that is, first fastening part 134 in the previous embodiment (see FIG. 4)) extending from the first reinforcing member 510 to be exposed to the outside of the first outer case 113, but is provided on the first reinforcing member 510 accommodated inside the first outer case 113. In addition, a first housing fastening hole 541 is provided at a position corresponding to the position of the first fastening hole 517 in the first outer case 113. That is, the first housing fastening hole 541 and the first fastening hole 517 are disposed to overlap when viewed from the outside of the first outer case 113. As described above, not only the connection structure as in this embodiment, but also the connection structure as in the previous embodiment may be applied to the upper plate surfaces of the first refrigerator 100 and the second refrigerator 200.

The connection member 530 is provided with a plurality of first housing fastening holes 541 and a plurality of first connection member fastening holes 533 corresponding to the plurality of first fastening holes 517. The first connection member fastening hole 533, the first housing fastening hole 541, and the first fastening hole 517 are sequentially screwed from the outside of the first outer case 113 by the screw, so the connection member 530 is coupled to the first refrigerator 100.

In addition, according to a similar structure, the plurality of second fastening holes 527 are provided on the second reinforcing member 520 accommodated inside the second outer case 213. In the second outer case 213, a second housing fastening hole 542 is provided at a position corresponding to the position of the second fastening hole 527. The connection member 530 is provided with a plurality of second connection member fastening holes 535 corresponding to the plurality of second housing fastening holes 542 and the plurality of second fastening holes 527 so as to be spaced apart from the first connection member fastening hole 533. The second connection member fastening hole 535, the second housing fastening hole 542, and the second fastening hole 527 are sequentially screwed from the outside of the second outer case 213 by the screw, so the connection member 530 is coupled to the second refrigerator 200.

In this way, the connection member 530 is screwed with the first refrigerator 100 and the second refrigerator 200 together, thereby physically coupling the first refrigerator 100 and the second refrigerator 200 (see B in FIG. 3).

On the other hand, the first fastening part or the second fastening part may reflect an additional configuration that assists in easy coupling with the connection member. Hereinafter, the embodiment will be described.

Figure 13:
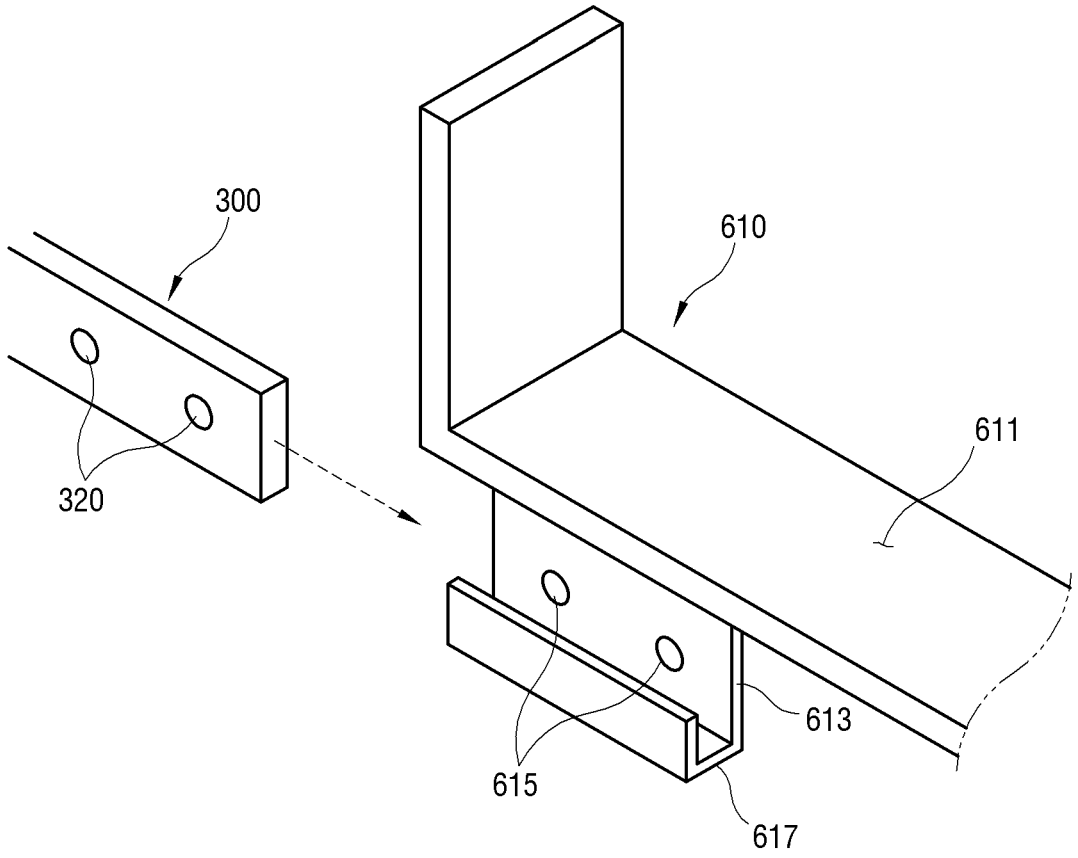
FIG. 13 is a perspective view illustrating the first fastening part to which a support structure of the connection member is applied.

FIG. 13 is a perspective view illustrating the first fastening part to which the support structure of the connection member is applied.

As illustrated in FIG. 13, a first reinforcing member 610 includes a first fastening part 613 extending downward from a reinforcing member body 611. A plurality of first fastening holes 615 are formed to penetrate through the first fastening part 613. Here, a first connection member support part 617 protruding to support the connection member 300 is provided on a plate surface (that is, a front surface of the first fastening part 613) of the first fastening part 613 provided to face the connection member 300.

The first connection member support part 617 may have various shapes within a range capable of supporting the connection member 300. In this embodiment, the first connection member support part 617 has a hook shape provided at a lower end portion of the first fastening part 613 and forms a groove supporting a lower end portion of the connection member 300. Alternatively, the connection member 300 may be provided so that a lower corner of the connection member 300 is seated by protruding from the lower end portion of the first fastening part 613 toward the front. When the first connection member support part 617 forms a groove, the connection member 300 slides from one end of the groove in a direction parallel to the plate surface of the first fastening part 613, and the first connection member fastening hole 320 is provided to move to a position corresponding to the first fastening hole 615.

Accordingly, the operation of coupling the connection member 300 to the first fastening part 613 becomes convenient.

Figure 14:
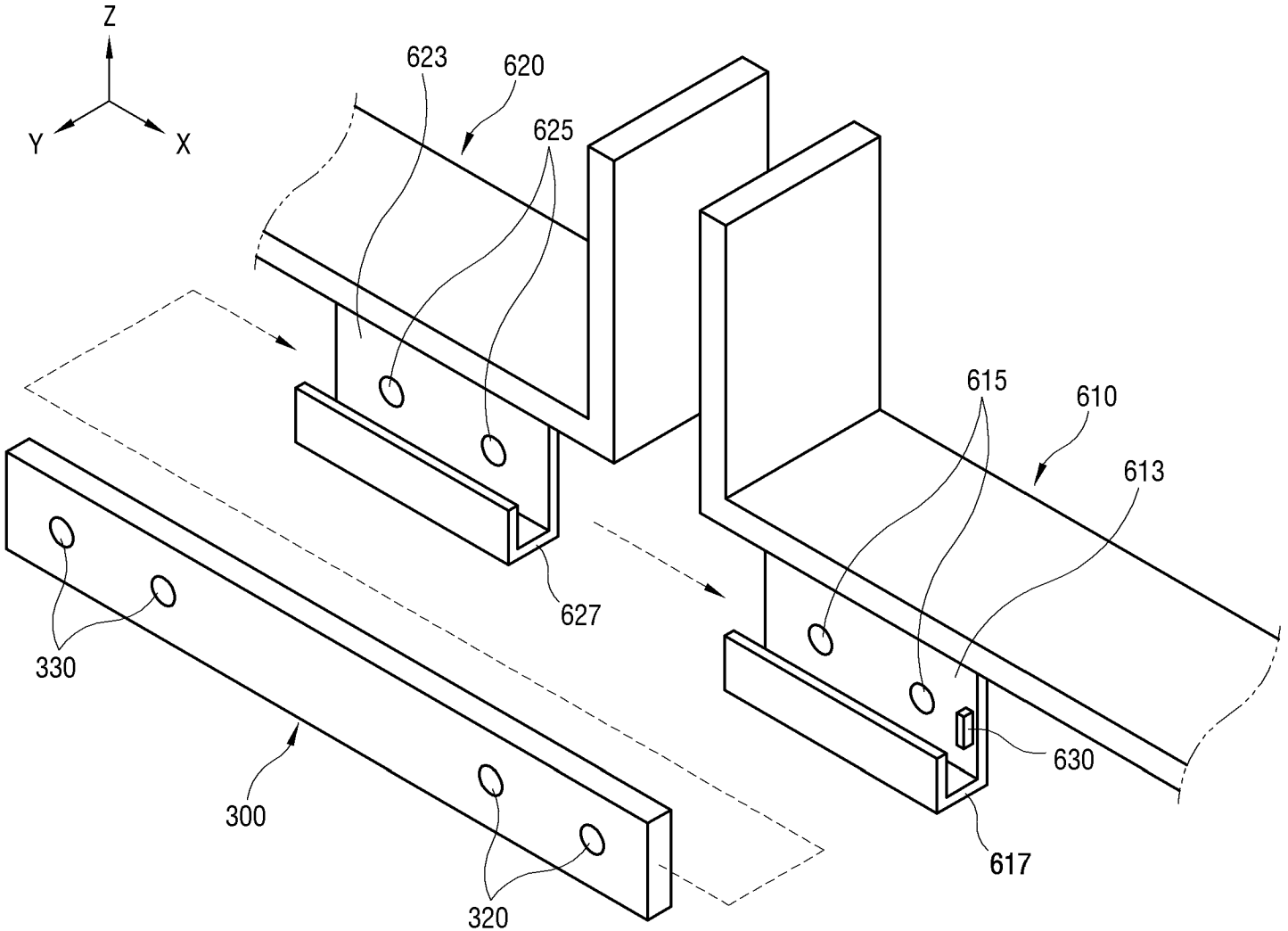
FIG. 14 is an exemplary view illustrating a state in which the support structure of the connection member is applied to the first fastening part and the second fastening part, respectively.

FIG. 14 is an exemplary view illustrating a state in which the support structure of the connection member is applied to the first fastening part and the second fastening part, respectively.

As illustrated in FIG. 14, in a structure similar to that in which the first connection member support part 617 is provided from the first fastening part 613 of the first reinforcing member 610, a second connection member support part 627 is provided from the second fastening part 623 of the second reinforcing member 620. In order to couple the connection member 300 to the first fastening part 613 and the second fastening part 623, for example, an X-direction end portion of the connection member 300 slides and moves in an X direction from a −X-direction end portion of the second connection member support part 627. The connection member 300 moves along plate surfaces of the second fastening part 623 and the first fastening part 613, respectively. At this time, the connection member 300 moves while the lower end portion of the connection member 300 is accommodated in a groove formed by the second connection member support part 627 and a groove formed by the first connection member support part 617.

Here, in this embodiment, a stopper 630 that blocks the slide of the connection member 300 protrudes from one of the first fastening part 613 and the second fastening part 623. For example, when the connection member 300 reaches a position where the first connection member fastening hole 320 and the second connection member fastening hole 330 each correspond to the first fastening hole 615 and the second fastening hole 625, the stopper 630 is provided on a movement path of the connection member 300 to block the movement of the connection member 300. In this embodiment, the stopper 630 is provided close to the right corner of the first fastening part 613 in consideration of the movement of the connection member 300 in the X direction. If the connection member 300 moves in the −X direction from the first connection member support part 617, the stopper 630 is provided close to the left corner of the second fastening part 623.

That is, if the first connection member support part 617 and the second connection member support part 627 are structured to form the groove, the connection member 300 is provided to slide along the plate surfaces of the first fastening part 613 and the second fastening part 623. In this case, since the connection member 300 needs to enter the groove, the stopper 630 is provided at the end of the movement path of the connection member 300 among the first fastening part 613 and the second fastening part 623.

Accordingly, when the connection member 300 is screwed to the first fastening part 613 and the second fastening part 623, the coupling position of the connection member 300 may be easily aligned.

Hereinafter, a configuration in which the alignment between the two refrigerators needs to be maintained will be described.

Figure 15:
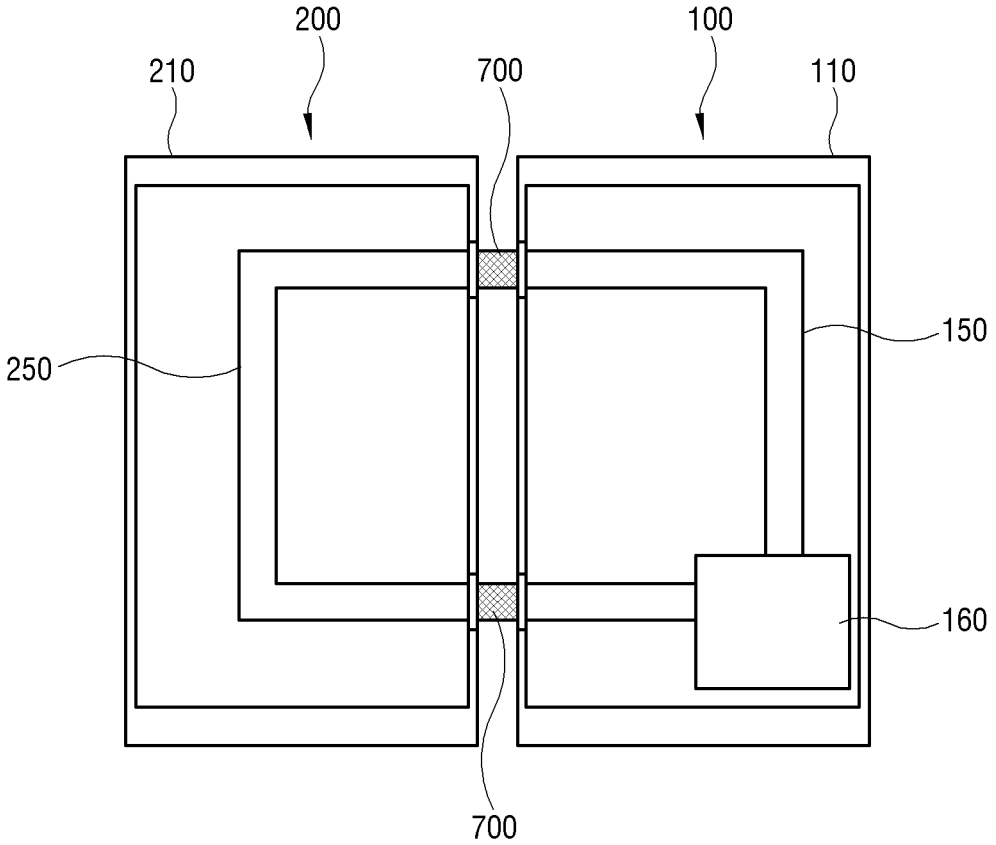
FIG. 15 is an exemplary view schematically illustrating a structure in which a channel is connected between a first refrigerator and a second refrigerator.

FIG. 15 is an exemplary view schematically illustrating a structure in which a channel is connected between the first refrigerator and the second refrigerator.

As illustrated in FIG. 15, the first refrigerator 100 includes a first channel 150 that guides a refrigerant to move in the first housing 110 and a cooling unit 160 that cools the refrigerant on the first channel 150. The cooling unit 160 includes a compressor 51 (see FIG. 2), a condenser, an evaporator 53 (see FIG. 2), and the like as described above with reference to FIG. 2. The second refrigerator 200 also includes a second channel 250 that guides the refrigerant to move in the second housing 210.

Typically, the first refrigerator 100 and the second refrigerator 200 may independently cool and use the refrigerant. However, when the performance of the cooling unit 160 of the first refrigerator 100 is sufficient, depending on the design method, only the cooling unit 160 of the first refrigerator 100 may perform the cooling of the first refrigerator 100 and the second refrigerator 200. In this case, the cooling unit of the second refrigerator 200 may not be operated.

For example, an end portion of the first channel 150 and an end portion of the second channel 250 are connected by a separate channel connection part 700. In this embodiment, it is illustrated that the first channel 150 and the second channel 250 are connected by two channel connection parts 700, but the locations and number of nodes connecting the first channel 150 and the second channel 250 are not limited, and therefore the channel connection part 700 is provided corresponding thereto. The first channel 150 and the second channel 250 communicate with each other by the channel connection part 700, and the refrigerant cooled by the cooling unit 160 of the first refrigerator 100 moves through the first channel 150, the channel connection part 700, and the second channel 250, and is circulated to the cooling unit 160 again. As described above, the first channel 150 and the second channel 250 communicate with each other by the channel connection part 700, so the first refrigerator 100 and the second refrigerator 200 may be cooled together only by the cooling unit 160 of the first refrigerator 100.

In such a case, it is important to align the channel connection part 700 connecting the first channel 150 and the second channel 250, and therefore the alignment of the first refrigerator 100 and the second refrigerator 200 needs to be maintained. Therefore, as described in the above-described embodiment, the connection structure that physically connects the first refrigerator 100 and the second refrigerator 200 is applied, thereby maintaining the position alignment.

What is claimed is:

1. A refrigerator, comprising:

an inner case configured to accommodate a refrigerated item therein;

an outer case configured to surround the inner case, the outer case including a fastening part through hole;

a heat insulator configured to be at least partially disposed between the inner case and the outer case;

a reinforcing member including a reinforcing member body embedded in the heat insulator to support an inner surface of the outer case, the reinforcing member having a fastening part extended from the reinforcing member body to be exposed outside the outer case through the fastening part through hole, wherein the fastening part is couplable to a connection member which is couplable to another refrigerator adjacent to the refrigerator to enable alignment between the refrigerator and the another refrigerator.

2. The refrigerator of claim 1, wherein the fastening part includes one or more fastening holes.

3. The refrigerator of claim 1, wherein the fastening part has a plate surface facing a front of the refrigerator.

4. The refrigerator of claim 1, wherein the reinforcing member body includes:

a first reinforcing part configured to extend along an inner surface of the outer case; and a second reinforcing part configured to be bent and extend from the first reinforcing part at a corner of the housing.

5. The refrigerator of claim 1, wherein the reinforcing member further includes a connection member support part protruded from the fastening part to support the connection member.

6. The refrigerator of claim 1, further comprising:

a second reinforcing member disposed at a position different from a position where the reinforcing member is installed and have a second fastening hole so that a second connection member is used to couple the refrigerator with the another refrigerator.

7. The refrigerator of claim 6, wherein the reinforcing member is disposed below the outer case, and the second reinforcing member is disposed above the outer case.

* * * * *